US008061634B2

(12) United States Patent
Sued et al.

(10) Patent No.: US 8,061,634 B2
(45) Date of Patent: Nov. 22, 2011

(54) SHREDDER HEAD WITH THICKNESS DETECTOR

(76) Inventors: Charles Sued, Brooklyn, NY (US); Aron Abramson, Brooklyn, NY (US)

( * ) Notice: Subject to any disclaimer, the term of this patent is extended or adjusted under 35 U.S.C. 154(b) by 201 days.

(21) Appl. No.: 12/390,973

(22) Filed: Feb. 23, 2009

(65) Prior Publication Data

US 2010/0213297 A1 Aug. 26, 2010

(51) Int. Cl.
*B02C 25/00* (2006.01)

(52) U.S. Cl. ..... 241/36; 241/101.3; 241/100

(58) Field of Classification Search ..... 241/35–36, 241/100, 101.2, 101.3, 236
See application file for complete search history.

(56) References Cited

U.S. PATENT DOCUMENTS

| | | | | |
|---|---|---|---|---|
| 2010/0084496 | A1 * | 4/2010 | Matlin et al. | 241/25 |
| 2010/0170967 | A1 * | 7/2010 | Jensen | 241/25 |
| 2010/0170969 | A1 * | 7/2010 | Jensen et al. | 241/25 |
| 2010/0176227 | A1 * | 7/2010 | Davis et al. | 241/34 |
| 2010/0252661 | A1 * | 10/2010 | Matlin et al. | 241/25 |
| 2010/0252664 | A1 * | 10/2010 | Matlin et al. | 241/36 |

* cited by examiner

*Primary Examiner* — Faye Francis
(74) *Attorney, Agent, or Firm* — Garcia-Zamor IP Law; Ruy M. Garcia-Zamor

(57) ABSTRACT

A shredder head adapted to indicate the thickness of the material to be shredded and to possibly deactivate the shredder if the thickness exceeds a predetermined maximum.

10 Claims, 6 Drawing Sheets

FIG. 3
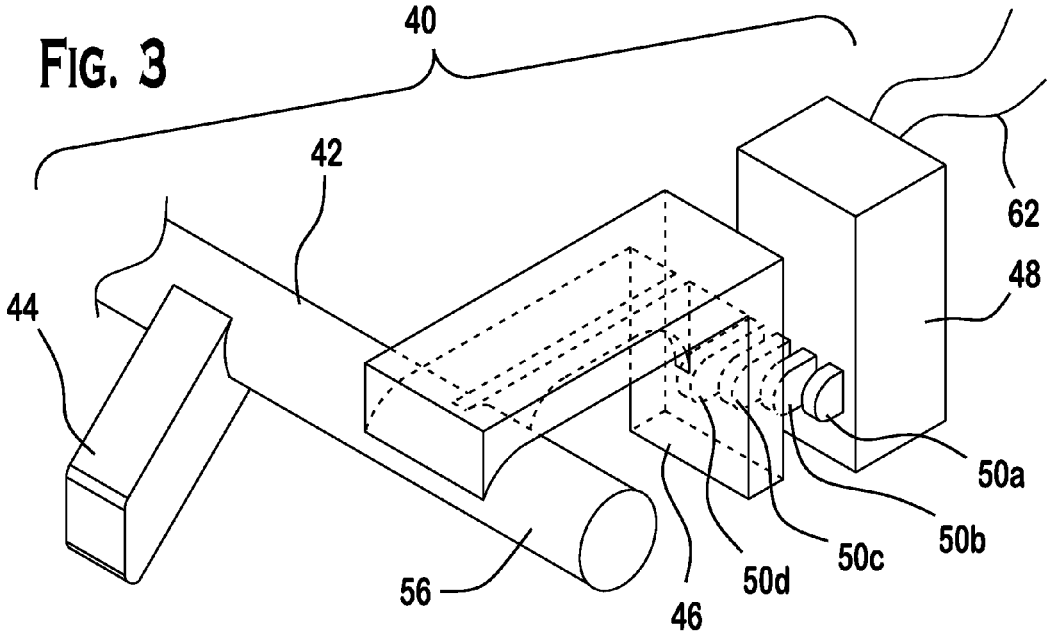
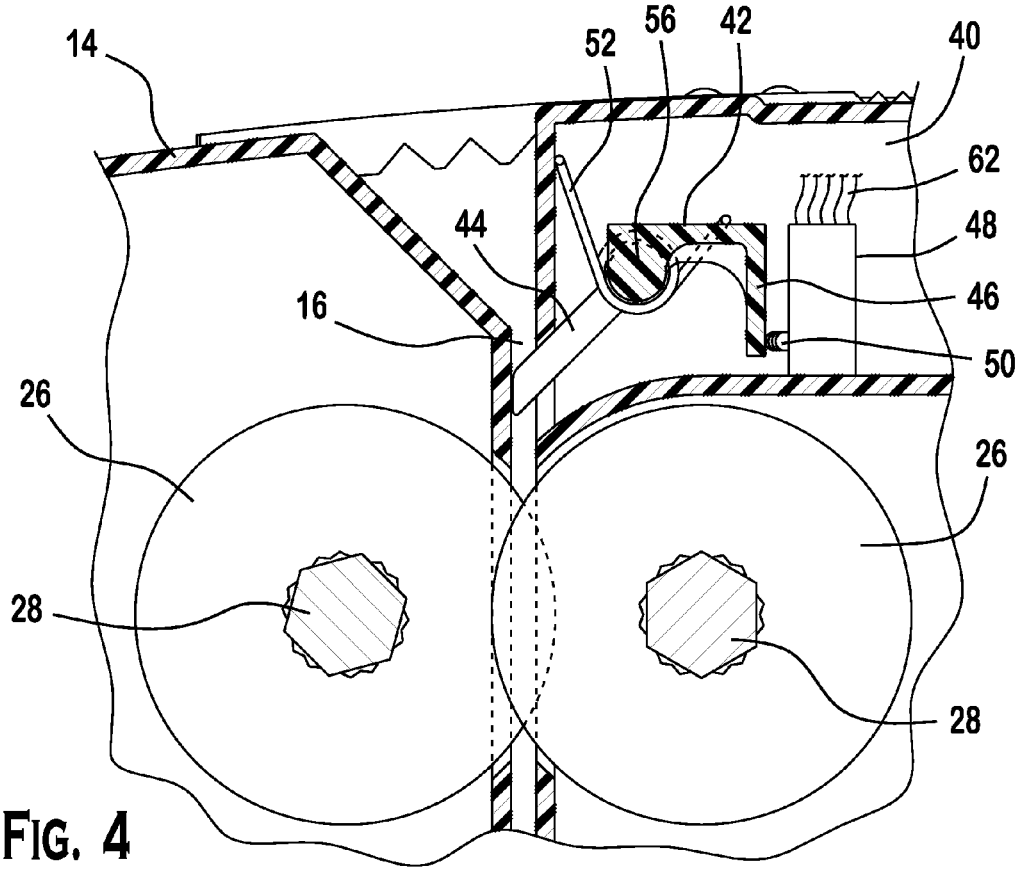
FIG. 4

SHREDDER HEAD WITH THICKNESS DETECTOR

BACKGROUND

The present invention is generally directed to shredders and, more specifically, to a shredder head adapted to monitor the thickness of material and provide an alert, an indication of thickness, and/or stop the operation of a shredder.

A shredder generally comprises a motor, gears, and a plurality of shredder blades which are driven by the motor through the gears. Conventional shredders operate the motor at the same power level regardless of the material presented to be shredded. The shredder motor may be capable of operating at higher power for a short period of time, but to increase the operating life of the motor and reduce power consumption the motor's power level is set to less than its operating maximum. The motor operating at a single power level may be unable to shred material of greater thickness, while consuming more power than necessary on less demanding shredding tasks.

It may be advantageous to provide a shredder head and/or method of disabling and/or monitoring the thickness of material inserted into a shredder.

SUMMARY

Briefly speaking, one embodiment of the present invention is directed to a shredder head including a shredder head housing defining a slot adapted to receive material to be shredded. A motor is disposed within the shredder head housing. An indicator display is disposed on the shredder head and is configured to provide an indication of the thickness of material being inserted into the slot. A plurality of shredder blades are disposed within the shredder head housing, driven by the motor, and adapted to shred material inserted into the slot. A sensor includes a thickness gauge and a control mechanism. The thickness gauge includes at least one protuberance disposed in the shredder head housing and adapted to extend into the slot such that material inserted into the slot that contacts the at least one protuberance causes displacement of the thickness gauge in an amount generally proportional to a thickness of the material. The control mechanism is disposed within the shredder head housing and includes a plurality of switches. At least one of the plurality of switches is adapted to be individually activatable. The plurality of switches are positioned such that displacement of the thickness gauge is adapted to cause at least one of the plurality of switches to be activated. The plurality of switches is configured such that a number and/or combination of the plurality of switches that are activated depend on the thickness of the material displacing the thickness gauge. The control mechanism is in communication with the indicator display so that the indicator display generates an audible or visual signal corresponding to the thickness of the material inserted in the slot in response to the activation of at least one of the plurality of switches.

In a separate aspect, one embodiment of the present invention is directed to a shredder head including a shredder head housing defining a slot adapted to receive material to be shredded. A motor is disposed within the shredder head housing. An indicator display is disposed on the shredder head and is configured to provide an indication of the thickness of material being inserted into the slot. A plurality of shredder blades are disposed within the shredder head housing, driven by the motor, and adapted to shred material inserted into the slot. A sensor includes a thickness gauge and a control mechanism. The thickness gauge includes at least one protuberance disposed in the shredder head housing and adapted to extend into the slot such that material inserted into the slot that contacts the at least one protuberance causes displacement of the thickness gauge in an amount generally proportional to the thickness of the material. The control mechanism is disposed within the shredder head housing, detects the amount of displacement of the thickness gauge, and causes the thickness to be indicated by the indicator display according to the amount of displacement of the thickness gauge.

In a separate aspect, one embodiment of the present invention is directed to a method of detecting the thickness of material inserted into a shredder head and displaying the thickness. The method includes: providing a shredder head housing defining a slot adapted to receive material to be shredded; providing a plurality of switches disposed in the shredder head housing, at least one of the plurality of switches being adapted to be independently activated; detecting a thickness of material inserted into the slot depending on the activation of at least one of the plurality of switches; and providing an indication of the thickness of the material inserted into the slot depending on the activation of at least one of the plurality of switches.

In a separate aspect, one embodiment of the present invention is directed to a shredder head. The shredder head including a shredder head housing that defines a slot which accommodates material to be shredded. The shredder head also includes a motor disposed within the shredder head housing, and a plurality of shredder blades which are disposed within the shredder head housing, driven by the motor, and adapted to shred material inserted into the slot of the shredder head housing. The shredder head also includes a sensor comprising a thickness gauge and a control mechanism. The thickness gauge is disposed within the shredder head housing and includes at least one protuberance which extends into the slot. If no material is inserted into the slot, the thickness gauge is in a first position in which the protuberance extends across the slot such that material inserted into the slot may contact the protuberance and cause displacement of the thickness gauge. The amount of displacement is generally proportional to the thickness of the material inserted into the slot. The control mechanism is disposed within the shredder head housing and is comprised of a plurality of switches, at least one of which can be activated independently of all others. Displacement of the thickness gauge will activate a grouping of at least one of the plurality of switches, the grouping reflecting the thickness of the material inserted into the slot. The control mechanism communicates with the motor and responds to the activation of at least one of the plurality of switches by activating the motor and selecting the power level of the motor that best suits the thickness of material inserted into the slot.

In a separate aspect, one embodiment of the present invention is directed to a shredder head. The shredder head includes a shredder head housing that defines a slot which accommodates material to be shredded. The shredder head also includes a motor disposed within the shredder head housing, and a plurality of shredder blades which are disposed within the shredder head housing, driven by the motor, and adapted to shred material inserted into the slot of the shredder head housing. The shredder head also includes a sensor comprising a thickness gauge and a control mechanism. The thickness gauge is disposed within the shredder head housing and includes at least one protuberance which extends into the slot. If no material is inserted into the slot, the thickness gauge is in a first position in which the protuberance extends across the slot such that material inserted into the slot may contact the protuberance and cause displacement of the thickness gauge. The amount of displacement is generally proportional to the thickness of the material inserted into the slot. The control mechanism is disposed within the shredder head housing and detects the amount of displacement of the thickness gauge. The control mechanism activates the motor and selects the power of the motor according to the amount of displacement of the thickness gauge.

In a separate aspect, one embodiment of the present invention is directed to a method of adjusting the power of a shredder according to the thickness of the material inserted into the shredder. The method includes the steps of: providing a shredder head housing defining a slot adapted to receive material to be shredded, providing a plurality of switches disposed in the shredder head housing, at least one of which can be independently activated, detecting a thickness of material inserted into the slot by the activation of at least one of the plurality of switches, and selecting the power of the shredder head according to the activation of at least one of the plurality of switches, thereby selecting the power of the shredder head that best suits the thickness of material inserted into the slot.

BRIEF DESCRIPTION OF THE DRAWINGS

The foregoing summary, as well as the following detailed description of the preferred embodiment of the present invention will be better understood when read in conjunction with the appended drawings. For the purpose of illustrating the invention, there are shown in the drawings an embodiment which is presently preferred. It is understood, however, that the invention is not limited to the precise arrangement and instrumentality shown. In the drawings:

FIG. 3 is a perspective view of one possible preferred sensor for use with the shredder of FIG. 1; The various preferred components of the sensor are collectively identified using a bracket that is labeled forty; The control mechanism may include 4 oval switches that each protrude out from the control mechanism base by an amount different from the neighboring switches; The switches can be depressed inwardly by the thickness gauge; At least one of the plurality of switches of the control mechanism is independently activatable; the switches are preferably positioned such that rotation of the thickness gauge causes the switching element of the thickness gauge to activate a grouping of the plurality of switches, the grouping must preferably includes at least one of the switches; the thickness gauge preferably includes the at least one protuberance, at least one switching element; the at least one protuberance may extend into the slot;

FIG. 4 is a cross sectional view of the shredder of FIG. 1 as taken along the line 4-4 of FIG. 2; the thickness gauge is generally shown in a preferred first position when no material is inserted into the slot and abutting the at least one protuberance; when the thickness gauge is in the first position, the switching element of the thickness gauge preferably activates none of the plurality switches and the control mechanism selects an unpowered state or a reduced power state for the motor; a biasing element, such as a torsion spring, preferably, but not necessarily, maintains the thickness gauge in the first position when no material is inserted into the slot and abutting the at least one protuberance;

DETAILED DESCRIPTION OF THE PREFERRED EMBODIMENTS

Figure 1:
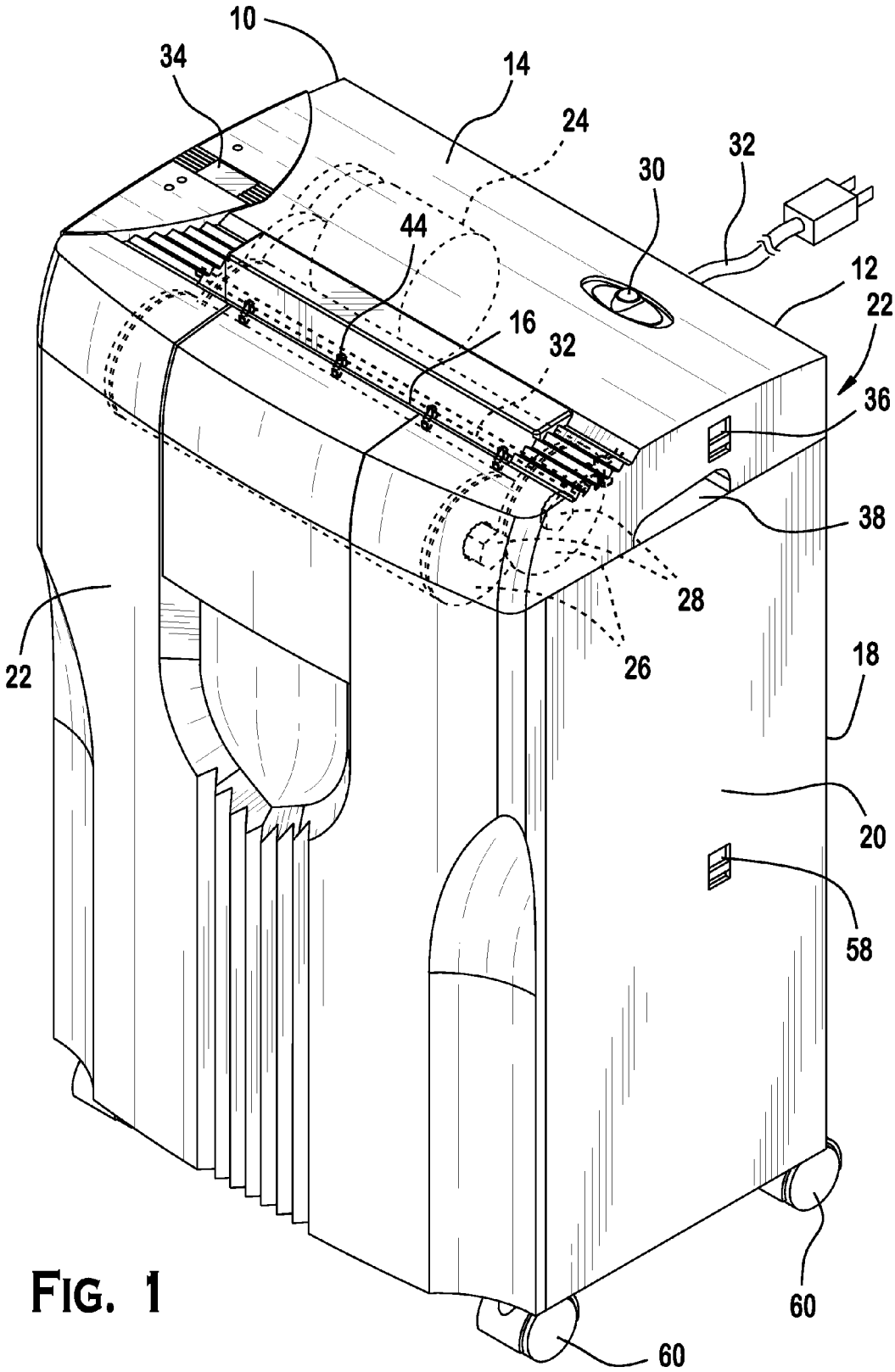
FIG. 1 is a perspective view of a shredder according to the preferred embodiment of the present invention; a shredder head housing defines a slot for receiving material to be shredded; a sensor comprises a thickness gauge and a control mechanism; the thickness gauge may include at least one protuberance adapted to extend into the slot such that material inserted into the slot may contact the thickness gauge and cause it to pivot about an axis generally parallel to the slot; Alternatively, the thickness gauge can slide, retract or deform in response to contact with inserted material without departing from the scope of the present invention; A motor is shown in dashed lines; The power of the motor may be adjusted or deactivated in response to the thickness of material inserted into the shredder head.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "material", as used in the claims and in corresponding portions of the specification, means "any of articles, paper, documents, data bearing documents, checks, deposit slips, office papers, envelopes, receipts, credit cards, identification cards, banking cards, any material for which shredding is desired, CDs, DVDs, or the like". The term "activated" as used with a motor means that the motor is moving in whatever manner results in shredding (i.e., that the shredder blades are operating for shredding). Similarly, the term "deactivated" when used with a motor means that it is not applying force to drive the shredder blades. The term "undesirable performance" when applied to a shredder means that material inserted for shredding is incompletely shredded, either due to the motor ceasing its motion or reversing after only partially shredding the material, or due to the material passing between the shredder blades without being fully shredded and separated into pieces. The term "selectable control" or "control", as used in the claims and the corresponding portions of the specification, means "any one of a physical switch, a touch switch, a button, a biometric control, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-9, wherein like numerals indicate like elements throughout, there is shown a preferred embodiment of a shredder 10 comprised of a shredder head 12 and a shredder base 18. The shredder head 12 includes a shredder head housing 14 which defines a slot 16 adapted to receive material to be shredded. The shredder head comprises a motor 24 and a plurality of shredder blades 26 disposed within the shredder head housing 14. The plurality of shredder blades are driven by the motor and are adapted to shred material 54 inserted into the slot 16. The shredder 10 of the present invention is preferably of the type used in homes, home offices, and offices to shred material which may include confidential data.

The shredder head 12 preferably includes a sensor 40 that can include a thickness gauge 42 and a control mechanism 48. The thickness gauge 42 can include at least one protuberance 44 disposed in the shredder head housing 14 and adapted to extend into the slot 16. Material 54 inserted into the slot 16 that contacts the at least one protuberance 44 should cause displacement of the thickness gauge 42 in an amount generally proportional to the thickness of the material 54. It is preferred that the control mechanism 48 is adapted to detect the amount of displacement of the thickness gauge 42 and adjust the power of the motor 24 according to the displacement of the thickness gauge 42. Alternatively, the thickness gauge 42 can be used to determine the thickness of material so that the thickness of material can be displayed, without adjusting the power of the motor, without departing from the scope of the present invention. If the material 54 is of sufficient thickness to cause undesirable performance of the shredder head 12, the increased displacement of the thickness gauge 42 is detected by the control mechanism 48, and the control mechanism 48 may cause the motor 24 to be deactivated.

It is preferred that an indicator mechanism 34 is located on the shredder head and configured to provide an indication of the thickness of material being inserted into the slot. The indicator mechanism can be any one or combination of different colored lights, an LED display, a LED array, an alphanumeric message, an audible sound that varies according to thickness (such as gets higher pitched), a verbal status alert, or any other suitable mechanism for communicating the thickness of material to a user.

While the preferred shredder head 12 has a generally rectilinear shape, those of ordinary skill in the art will appreciate from this disclosure that the shredder head 12 can have any shape without departing from the scope of the present invention.

Referring in FIG. 1, the shredder head 12 may be used with a shredder base 18 including a shredder base housing 20 and a shredder basket 22 that has an opening located proximate to the shredder head 12 and is adapted to receive material 54 shredded by the plurality of shredder blades 26. The shredder basket 22 is preferably removably located at the front side of the shredder base housing 20. A shredder basket release 58 may be located on the lateral sides of the shredder base housing 20, and when the position of the shredder basket release 58 is changed, the shredder basket 22 may be removed from the shredder base housing 20. The shredder base 18 may include a plurality of wheels 60 located on the bottom surface of the shredder base housing 20 which increase the ease of positioning the shredder 10. However, those of ordinary skill in the art will appreciate from this disclosure that the shredder head 12 can be used with any type of receptacle or shredder basket without departing from the scope of the present invention.

The shredder head 12 preferably includes a selectable control 30. When the selectable control 30 is deactivated, the motor 24 is deactivated. When the selectable control 30 is activated, the motor 24 may be activated (in combination with input from the sensor 40 or independently of any input from the sensor) so that the plurality of shredder blades 26 are operating for shredding.

The shredder 10 preferably receives power from an outlet via a power conduit, such as an electrical cord, 32. However, the shredder can be powered by batteries or any other suitable power source.

The shredder head 12 may also include an indicator display 34 or other operational indicators and/or controls. The control mechanism 48 of the sensor 40 preferably communicates with the indicator display 34 to indicate the thickness of the material 54 inserted into the slot 16 as detected by the displacement of the thickness gauge 42, and to indicate when the material 54 inserted into the slot 16 is of sufficient thickness to cause the control mechanism 48 to cause the motor 24 to be deactivated.

A shredder head release 36 may be located on the lateral sides of the shredder head housing 14, and when the position of the shredder head release 36 is changed, the shredder head 12 may be removed from the shredder base 14. Shredder head handles 38 may be located on the left and right lateral sides of the shredder head housing 14 to facilitate lifting of the shredder head 12 from the shredder base 14.

Figure 2:
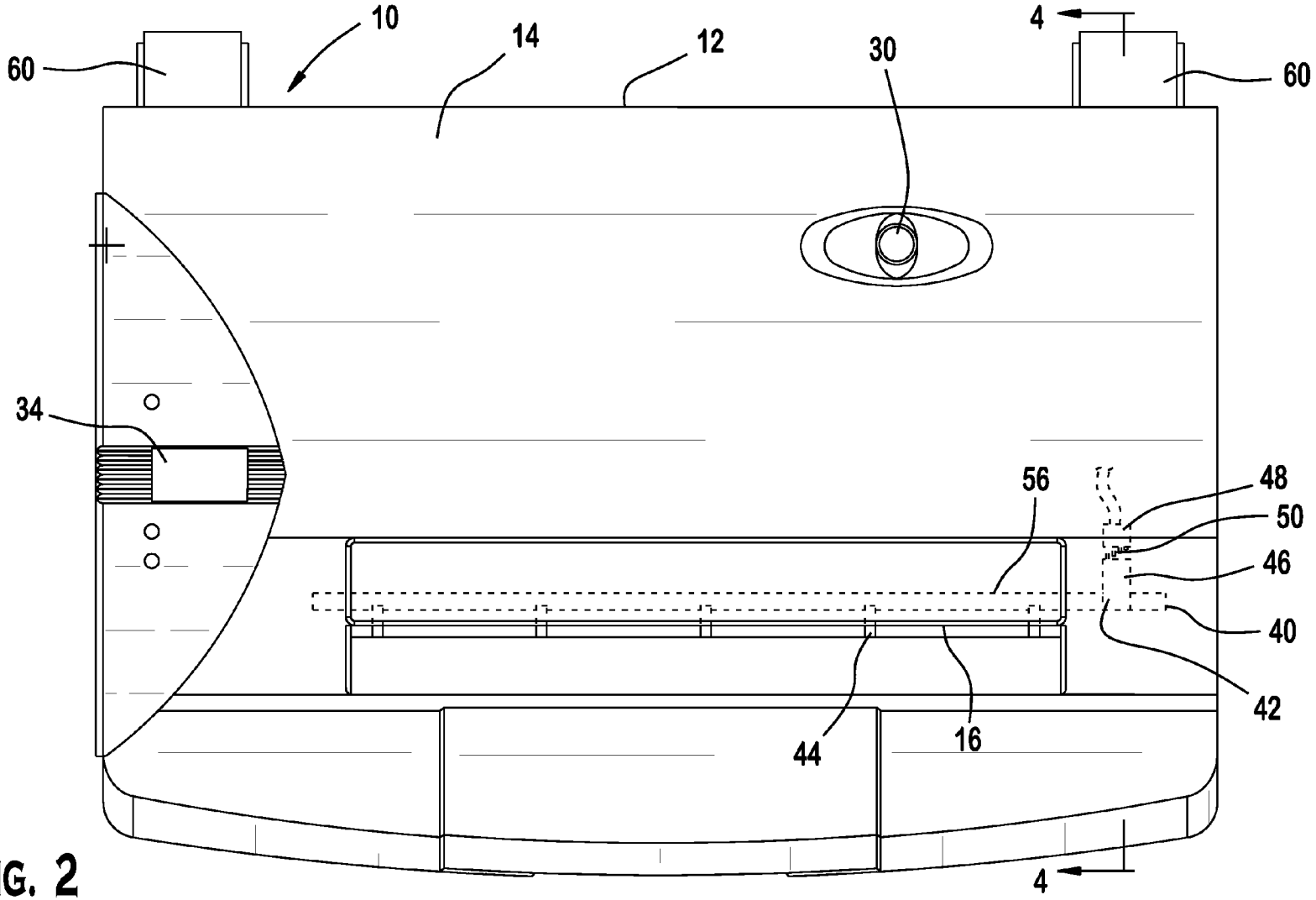
FIG. 2 is a top plan view of the shredder of FIG. 1; the sensor may include the thickness gauge and a control mechanism; the control mechanism may include a plurality of switches; the thickness gauge can include a switching element which is proximate to the plurality of switches; the at least one protuberance of the thickness gauge may comprise five spread apart protuberances; However any kind or number of protuberance may be used without departing from the scope of the present invention.

Referring to FIG. 2, the control mechanism 48 of the sensor 40 is comprised of a plurality of switches 50, at least one of which is adapted to be individually activatable. The thickness gauge 42 may include at least one protuberance 44, a pivot element 56 and a switching element 46 which is preferably proximate to the plurality of switches 50 of the control mechanism 48. The at least one protuberance 44 can extend from the pivot element 56 into the slot 16 such that material 54 inserted into the slot 16 may contact at least one protuberance 44. While the at least one protuberance is shown as including five generally equally spaced members connected via a common rod, those of ordinary skill in the art will appreciate from this disclosure that any number of members, including just one, can be used without departing from the scope of the present invention. Furthermore, the members can be rod shaped, be a sheet of material to form a continuous lip along the length of the slot or have any other shape or configuration without departing from the scope of the present invention.

As best shown in FIG. 3, it is preferred, but not necessary, that there are four switches 50*a*, 50*b*, 50*c*, 50*d* (also collectively referred to as 50) that each extend laterally from the control mechanism base and have a different length. It is preferred that the switches are arrayed in order of increasing or decreasing length such that as the thickness gauge moves an additional incremental amount an additional switch is activated or one of the currently activated switches is deactivated. This allows the thickness gauge to activate different groupings of the plurality of switches. A grouping may include a single switch or any combination of switches. While a preferred configuration is shown for the sensor, those of ordinary skill in the art will appreciate that any suitable known sensor can be used without departing from the scope of the present invention. As such the number of switches, type of control mechanism, type of thickness gauge, the type of thickness member, or the configuration of any of the components of the sensor can be varied without departing from the scope of the present invention.

Referring still to FIG. 3, the switching element 46 of the thickness gauge 42 is preferably proximate to the control mechanism 48. The thickness gauge 42 pivots about an axis generally parallel to the slot 16, defined in this implementation by the axis of the pivot element 56. Those of ordinary skill in the art will appreciate that thickness gauge can pivot about an axis askew to the slot by up to approximately fifteen degrees while still being considered generally parallel.

The amount of rotation of the thickness gauge is preferably generally proportional to the thickness of material 54 inserted into the slot 16. A sufficient amount of rotation will cause the switching element 46 to activate a grouping of the plurality of switches 50 of the control mechanism 48. The grouping may include only a single one of the plurality of switches 50. The grouping preferably increases in the number of switches included therein as the thickness of the material 54 inserted into the slot 16 increases and causes the rotation of the thickness gauge 42 about the pivot element 56 to increase. In this embodiment, the plurality of switches 50 constitutes four switches 50.

Referring to FIG. 4, the shredder head 12 is shown with no material 54 inserted into in slot 16. The thickness gauge 42 can be maintained in a first position by a biasing element 52. The biasing element 52 may be a torsion spring which is adapted to rotate the thickness gauge 42 about the pivot element 56 such that the at least one protuberance 44 extends into the slot 16 when material does not displace the thickness gauge 42. Those of ordinary skill in the art will appreciate from this disclosure that any suitable biasing element can be used without departing from the scope of the present invention.

The switching element 46 is preferably proximate to the plurality of switches 50 of the control mechanism 48, and when the thickness gauge is in the first position, the switching element does not activate any of the plurality of switches 50. The control mechanism 48 has not activated the motor 24 or is just operating the motor at a low speed so that the motor can be easily ramped up to the desired power level when material is inserted into the slot. The plurality of shredder blades 26 are arranged about the shredder axles 28 and are not operating for shredding.

As mentioned above, in an alternate embodiment of the shredder head 12, when the selectable control 30 is activated and the thickness gauge 42 is in the first position, the control mechanism 48 selects the power of the motor 24 to be at a reduced level, such that the plurality of shredder blades 26 are rotating. Upon insertion of material 54 into the slot 16, the control mechanism 48 will increase the power level of the motor 24 such that the plurality of shredder blades 56 reach an appropriate cutting speed to shred the material 54 more rapidly and effectively than would be possible if starting the motor 24 from a deactivated state.

Figure 5:
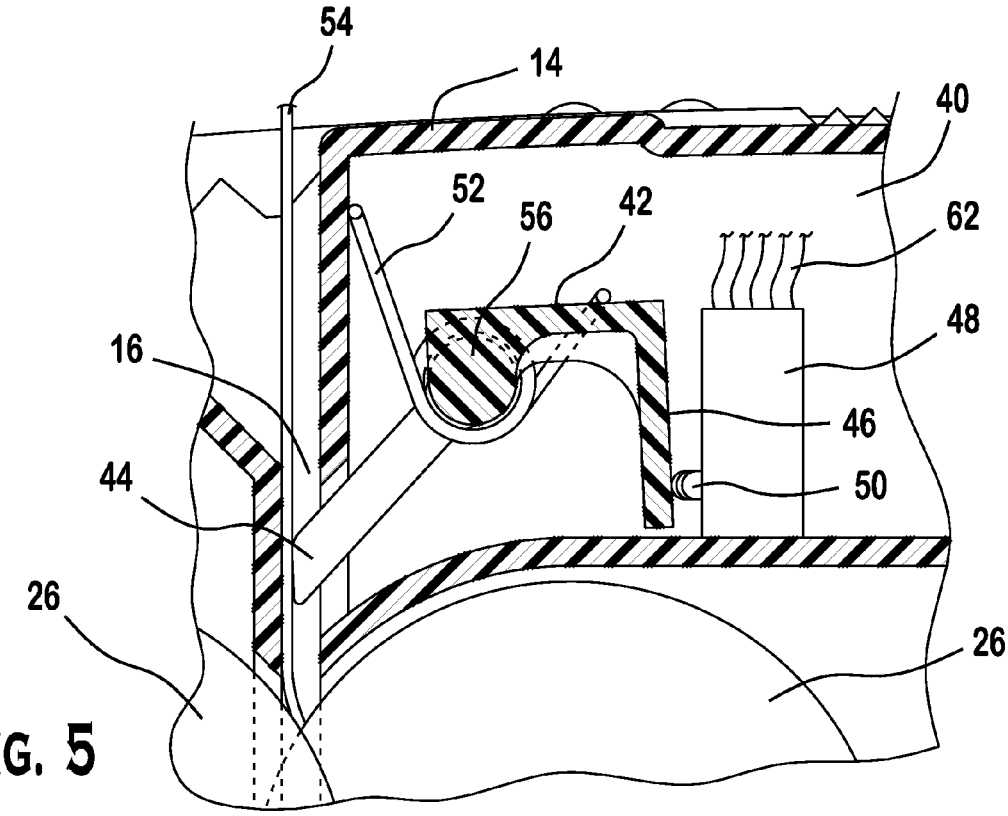
FIG. 5 is an enlarged, cross sectional view of the shredder of FIG. 1 as taken along the line 4-4 of FIG. 2; material inserted into the slot preferably causes the thickness gauge to pivot such that the switching element component of the thickness gauge activates at least one of the plurality of switches resulting in the control mechanism selecting a power state for the motor that corresponds to the thickness of the material inserted in the shredder; It is preferred that the power of the motor is generally less than that which would be used for shredding thicker material; It is preferred that only the longest of the switches is contacted by the material shown in this Figure; Instead of modifying the power of the motor, the engagement of the thickness gauge with material shown in FIGS. 5-8 may result in the controller causing the indicator display to generate an audible, alphanumeric, or visual indication of thickness without departing from the scope of the present invention.

Referring to FIG. 5, material 54 has been inserted into the slot 16 and caused the thickness gauge 42 to rotate about the pivot element 56 from the first position. The rotation causes the switching element 46 to activate a grouping of at least one of the plurality of switches 50. In this instance, the grouping preferably includes only one of the four switches 50. The control mechanism 48 responds to the activation of the grouping of switches 50, and as the thickness of the material 54 indicates that an elevated power level may not be necessary, the control mechanism communicates with the motor 24 and selects a power state for the motor that corresponds to the thickness of the material inserted in the shredder which is preferably greater than that selected when the thickness gauge is in the first position. The motor 24 causes the plurality of shredder blades 26 to rotate and shred the material 54. Alternatively, the control mechanism can be in communication with the indicator display 34 so that the indicator display preferably generates an audible or visual signal (as described above) corresponding to the thickness of the material inserted into the slot (without modulating the power of the motor based on the thickness of the material) without departing from the scope of the present invention. Additionally, in another embodiment, the control mechanism can cause the indicator display to communicate the thickness to a user and also deactivate the shredder when the thickness gauge indicates that the material inserted into the shredder exceeds a predetermined amount (such as when the thickness would impair performance or create a jam). The below description of FIGS. 6-7 which is directed to adjusting the power of the motor also describes how the control mechanism can determine thickness for communication to the indicator display to allow the display 34 to indicate thickness without adjusting the power of the motor, except for possible deactivation if the amount of thickness is sufficient to cause undesirable performance of the shredder.

Figure 6:
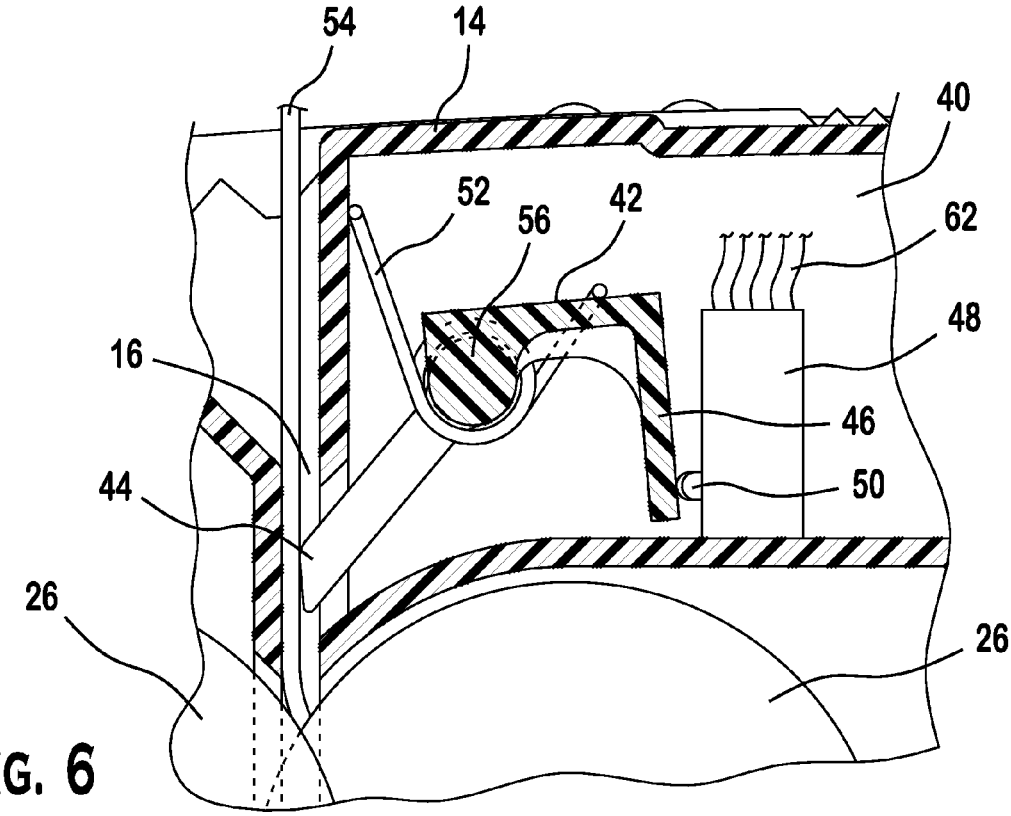
FIG. 6 is an enlarged, cross sectional view of the shredder of FIG. 1 as taken along the line 4-4 of FIG. 2; The Figure illustrates material having a greater thickness than that shown in FIG. 5 inserted into the slot and causing the thickness gauge to pivot such that the switching element activates a grouping of two of the plurality of switches; It is preferred that the two activated switches are the longest of the plurality of switches; It is preferred that the amount of power of the motor selected is greater than that shown in FIG. 5.

Referring to FIG. 6, a greater thickness of material 54 has been inserted into the slot 16 and caused the thickness gauge 42 to rotate about the pivot element 56 further from the first position. The increased rotation causes the switching element 46 to activate a grouping of at least one of the plurality of switches 50. This grouping preferably includes two of the plurality of switches 50. The control mechanism 48 responds to the activation of the grouping of switches 50, and as the thickness of the material 54 indicates that an elevated power level will be most effective to shred the material 54, communicates with the motor 24 and selects a power state for the motor that corresponds to the thickness of the material inserted in the shredder. The power level is preferably higher than that selected in connection with the material thickness shown in FIG. 5. The motor 24 causes the plurality of shredder blades 26 to rotate and shred the greater thickness of material 54.

Figure 7:
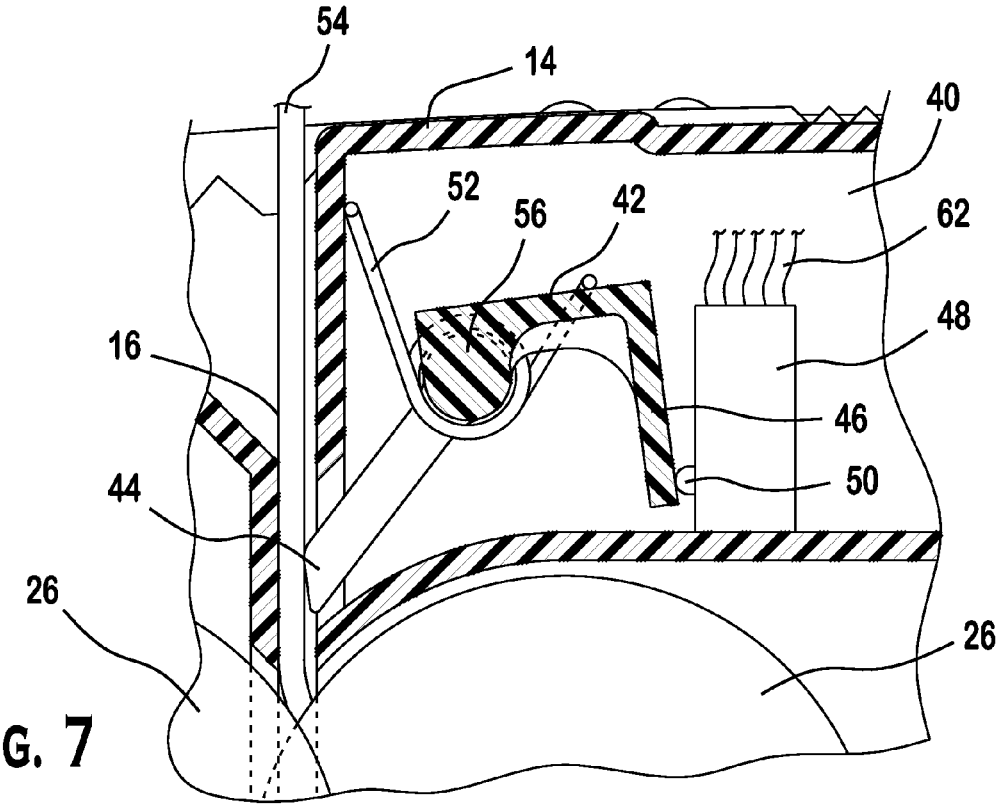
FIG. 7 is an enlarged, cross sectional view of the shredder of FIG. 1 as taken along the line 4-4 of FIG. 2; The Figure illustrates material having a greater thickness than that shown in FIG. 6 inserted into the slot and causing the thickness gauge to pivot such that the switching element activates a grouping of three of the plurality of switches; It is preferred that the three activated switches are the longest of the plurality of switches; It is preferred that the amount of power of the motor selected is greater than that shown in FIG. 6.

Referring to FIG. 7, a still greater thickness of material 54 has been inserted into the slot 16 and caused the thickness gauge 42 to rotate about the pivot element 56 through a larger angle of rotation from its first position. The increased rotation causes the switching element 46 to activate a grouping of at least one of the plurality of switches 50 which, in this instance, preferably includes three of the four switches 50. The control mechanism 48 responds to the activation of the grouping of switches 50, and as the thickness of the material 54 indicates that the highest power level will be most effective to shred the material 54, communicates with the motor 24 and selects a power state for the motor that corresponds to the thickness of the material inserted in the shredder. The power level is preferably higher than that selected in connection with the material thickness shown in FIG. 6. The motor 24 causes the plurality of shredder blades 26 to rotate with their highest power and shred the still greater thickness of material 54.

Figure 8:
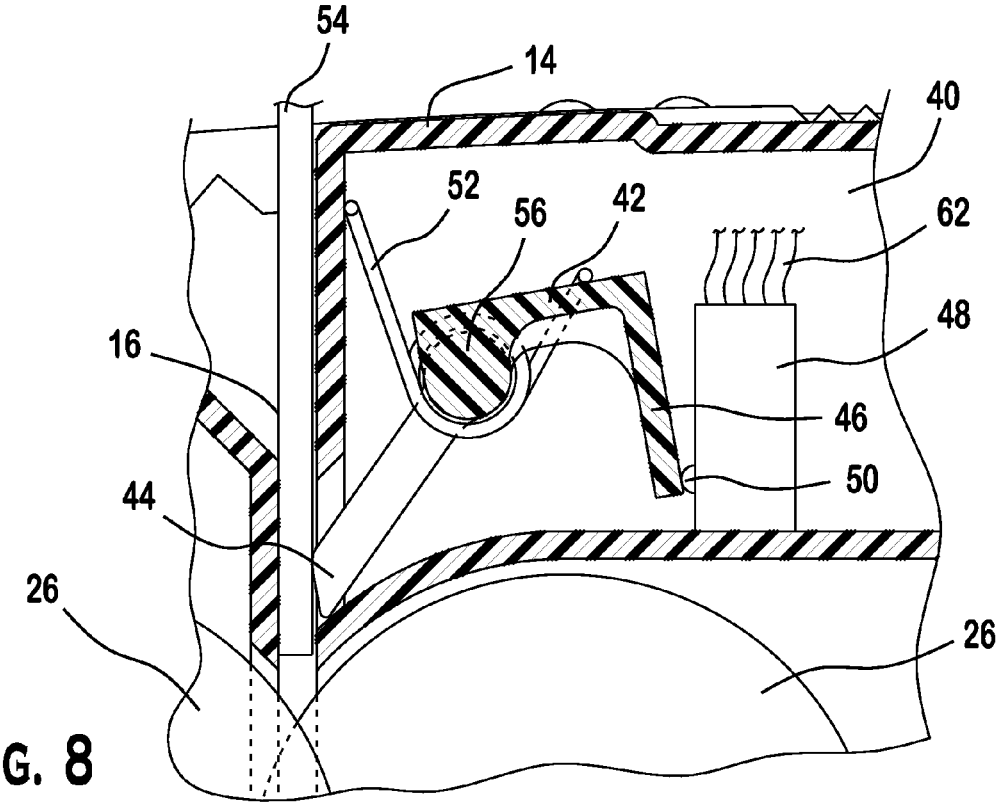
FIG. 8 is an enlarged, cross sectional view of the shredder of FIG. 1 as taken along the line 4-4 of FIG. 2; The Figure illustrates material having a greater thickness than that shown in FIG. 7 inserted into the slot and causing the thickness gauge to pivot such that the switching element activates a grouping of four of the plurality of switches; It is preferred that the four activated switches are the longest of the plurality of switches; It is preferred that the amount of power of the motor selected is greater than that shown in FIG. 7; However, if the illustrated thickness is sufficient to jam the shredder head or to prevent satisfactory operation of the shredder, then the control mechanism may depower/deactivate the motor and activate a warning indicator; Although a preferred embodiment of the sensor has been shown in FIGS. 5-8, one of ordinary skill in the art will appreciate from this disclosure that any suitable sensor can be used with the shredder head without departing from the scope of the present invention; Similarly, the number and configuration of the switches, protuberances, thickness gauges can vary without departing from the scope of the present invention.

Referring to FIG. 8, the material 54 inserted into the slot 16 is of sufficient thickness that the shredder head 12 will be unable to adequately shred the material 54 even at the highest power of the motor 24. Attempting to shred the material 54 can cause undesirable performance of the shredder head 12, incomplete shredding or separation of material after passing through the shredder blades, damage the plurality of shredder blades 26 or damage the motor 24. The material 54 inserted into the slot 16 has caused the thickness gauge 42 to rotate about the pivot element 56 through a still larger angle or rotation from its first position, relative to that shown in FIG. 7. The increased rotation causes the switching element 46 to activate a grouping of the plurality of switches 50 which preferably includes all of the four switches 50. The control mechanism 48 responds to the activation of the grouping of switches 50, and as the thickness of the material 54 indicates that attempting to shred the material can cause undesirable performance of the shredder head 12, the control mechanism communicates with the motor 24 and preferably deactivates the motor 24. The control mechanism preferably also communicates with the indicator display 28 to indicate to the user that the thickness of material 54 inserted into the shredder 10 has caused the motor to be deactivated. The indicator can be an LED, warning text on a display screen, a warning sound, or a prerecorded audible message, or the like.

Still referring to FIG. 8, in an alternate embodiment of the shredder head 12, the shredder has sufficient power to shred any thickness of material 54 which can enter the slot 16. The material 54 inserted into the slot 16 causes the thickness gauge 42 to rotate about the pivot element 56 a sufficient angle from its first position to indicate that the motor must operate at its maximum power level to efficiently shred the material 54. The switching element 46 of the thickness gauge 42 activates a grouping of the plurality of switches 50 constituting all of the four switches 50. The control mechanism 48 responds to the activation of the grouping of switches 50 by communicating with the motor 24 and selecting a maximum level of power. The motor 24 causes the plurality of shredder blades 26 to rotate with their maximum power and shred the material 54.

While the use of four possible groupings has been discussed above to show four gradations in the measurement of thickness, those of ordinary skill in the art will appreciate from this disclosure that any number of thickness gradations (buttons) can be used to allow precise motor power control. While the use of switches has been shown, any suitable mechanism for measuring the displacement of the thickness gauge can be used without departing from the scope of the present invention. For example, an optical sensor can be used to measure displacement, a multi-stage button can be used, or any other suitable mechanism for detecting displacement of the thickness gauge.

Figure 9:
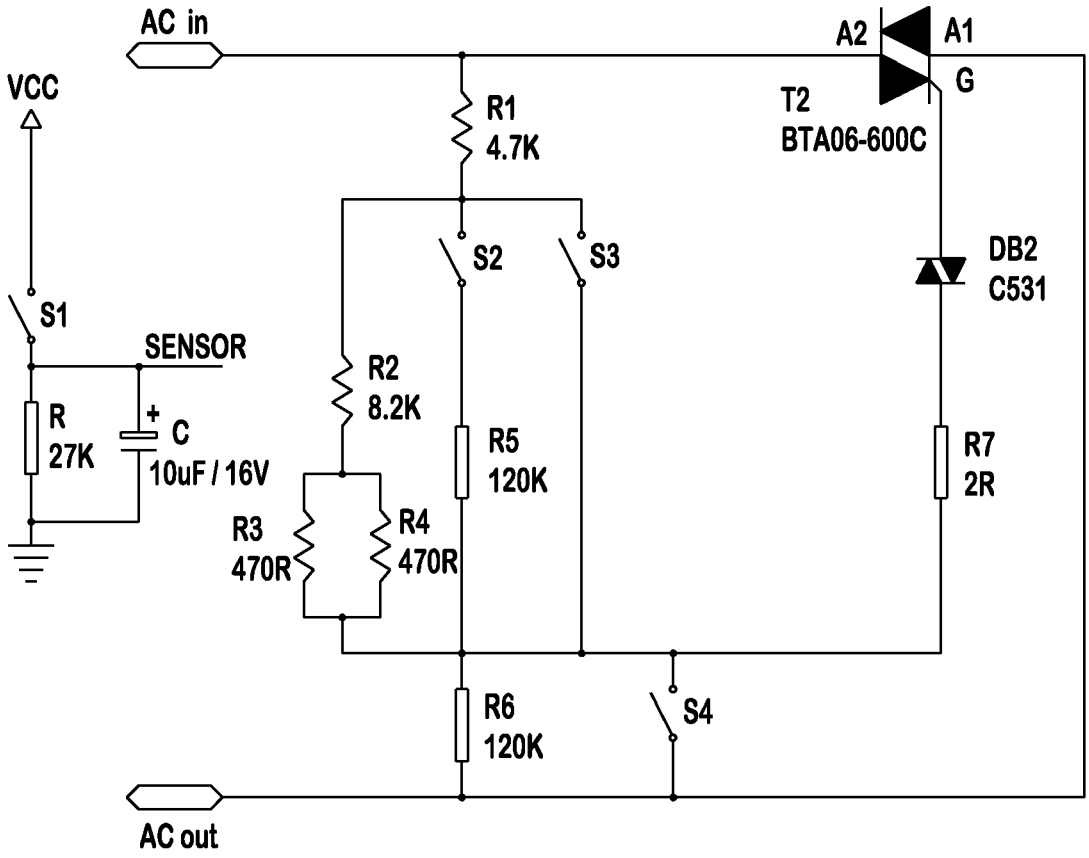
FIG. 9 is an schematic circuit of an exemplary control mechanism for the shredder of FIG. 1; the voltage of the AC output is changed by the activation of a grouping of the plurality of switches; the voltage of the AC output sets the power state of the motor; those of skill in the art will appreciate that the present invention can be used with any suitable circuit without departing from the scope of the present invention.

Referring to FIG. 9, the control mechanism 48 uses the input of the four switches 50 to alter the amount of AC power delivered to the motor 24. A sensor connected to the motor will allow the motor to start only when the sensor is not at ground voltage. When none of the switches 50 are activated, corresponding to the switch position of FIG. 4, switch S1 is open, the sensor is at ground voltage, and the motor will not start. When only one switch is activated, corresponding to the switch position of FIG. 5, switch S1 is closed, activating the sensor, and the circuit activates the triac (TRIode for Alternating Current) T2 at its lowest level. The voltage of the AC output is then at its lowest level, placing the motor 24 into its lowest power state. When two switches are activated, corresponding to the switch position of FIG. 6, switch S2 is closed, which lowers the resistance circuit and further activates triac T2. The voltage of the AC output is increased, placing the motor 24 into its middle power state. When three switches are activated, corresponding to the switch position of FIG. 7, switch S3 further lowers the resistance of the AC circuit, fully activating triac T2, increasing the voltage of the AC output to its highest level and placing the motor 24 into its highest power state. When all four switches are activated, corresponding to the switch position of FIG. 8, switch S4 causes the input to triac T2 to short circuit to the ground voltage, reducing the AC output voltage to zero and deactivating the motor. While one exemplary circuit has been shown, those of skill in the art will appreciate that the present invention can be used with any suitable circuit(s) without departing from the scope of the present invention.

A preferred implementation of the preferred method of the present invention will be described below (alone or in combination with various embodiments of the shredder head). The steps of the method of the present invention can be performed in any order, omitted, or combined without departing from the scope of the present invention. As such, optional or required steps described in conjunction with one implementation of the method can also be used with another implementation or omitted altogether. Additionally, unless otherwise stated, similar structure or functions described in conjunction with the below method preferably, but not necessarily, operate in a generally similar manner to that described elsewhere in this application.

One method according to the present invention is directed to a method of detecting the thickness of material 54 inserted into a shredder head 12 and adjusting the power of the shredder head 12. The method includes providing a shredder head housing 14 defining a slot 16 adapted to receive material 54 to be shredded. A plurality of switches 50 are provided and are disposed in the shredder head housing 14. At least one of the plurality of switches 50 is preferably adapted to be independently activated. A thickness of material 54 inserted into the slot 16 is detected depending on the activation of at least one of the plurality of switches 50. The power of the shredder head 12 may be selected depending on the thickness of the material 54 as indicated by the activation of at least one of the plurality of switches 50. Alternatively, an indication of the thickness of the material inserted into the slot may be provided depending on the activation of at least one of the plurality of switches.

The method may include pivoting a thickness gauge 42 about an axis generally parallel to the slot 16 such that the amount of rotation of the thickness gauge 42 is generally proportional to the thickness of the material 54. The step of pivoting the thickness gauge 42 may further include exerting force on the thickness gauge 42 with a biasing element 52 to maintain the thickness gauge 42 in a first position (shown in FIG. 4) when no material 54 displaces the thickness gauge 42.

The method of the present invention may also include the thickness gauge 42 activating at least one of the plurality of switches 50 upon pivoting away from its first position. The number of switches 50 activated by the displacement of the thickness gauge 42 preferably generally increases as the displacement of the thickness gauge 42 increases. The step of detecting the thickness of material 54 inserted into the slot 16 may include providing a thickness gauge 42 disposed within the shredder head housing and extending into the slot and displacing the thickness gauge 42 upon insertion into the slot of material to be shredded such that the displacement of the thickness gauge 42 is generally proportional to the thickness of the material. The thickness gauge 42 may be displaced by rotary motion, by linear sliding, or by undergoing any other type of movement in response to contact with the material 54 to be shredded. The step of detecting the thickness of material 54 may include the thickness gauge 42 activating at least one of the plurality of switches 50 when material is inserted into the slot 16.

It is recognized by those skilled in the art that changes may be made to the above described methods and/or shredder head 12 without departing from the broad inventive concept thereof. For example any other thickness gauge configuration, such as a sliding gauge or piezoelectric circuit, that allows for the detection of thickness of material 54 inserted into the slot 24 of the shredder head 12 can be used without departing from the scope of the present invention. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A shredder head comprising:

a shredder head housing defining a slot adapted to receive material to be shredded;

a motor disposed within the shredder head housing;

an indicator display disposed on the shredder head and configured to provide an indication of the thickness of material being inserted into the slot;

a plurality of shredder blades disposed within the shredder head housing, driven by the motor and adapted to shred material inserted into the slot;

a sensor comprising a thickness gauge and a control mechanism, the thickness gauge comprising at least one protuberance disposed in the shredder head housing and adapted to extend into the slot such that material inserted into the slot that contacts the at least one protuberance causes displacement of the thickness gauge in an amount generally proportional to the thickness of the material, the thickness gauge of the sensor pivots about an axis generally parallel to the slot, and comprises a switching element which is proximate to a plurality of switches and which activates a grouping of the plurality of switches, the grouping including at least one of the plurality of switches and increasing in number as the thickness of the material increases;

the control mechanism is disposed within the shredder head housing, detects the amount of displacement of the thickness gauge, and causes the thickness to be indicated by the indicator display according to the amount of displacement of the thickness gauge, the control mechanism comprises the plurality of switches, at least one of the plurality of switches is adapted to be individually activatable, and the plurality of switches are positioned such that displacement of the thickness gauge is adapted to cause at least one of the plurality of switches to be activated.

2. The shredder head of claim 1, wherein the sensor comprises at least one biasing element which maintains the thickness gauge in a first position when no material is inserted into the slot.

3. The shredder head of claim 2, wherein the insertion of material of sufficient thickness to cause undesirable performance of the shredder causes activation of a grouping of the plurality of switches which causes the motor to be deactivated.

4. The shredder head of claim 3, wherein the sensor communicates with an indicator display on an outer surface of the shredder head to indicate the thickness of the material inserted into the shredder head and to indicate when the thickness of the material inserted into the shredder head has caused the motor to be deactivated.

5. The shredder head of claim 4, wherein the shredder head housing defines a plurality of slots, wherein at least one of the plurality of slots is adapted to be generally monitored by the sensor.

6. The shredder head of claim 5, wherein the sensor further comprises a plurality of gauges disposed within the plurality of slots, the one or more gauges communicates with the control mechanism to indicate when has been inserted into the one or more additional slots.

7. The shredder head of claim 6, wherein the control mechanism is adapted to respond to the input of the plurality of gauges by selecting the power of the motor to allow optimal shredding of the material inserted into the one or more slots.

8. The shredder of claim 2, wherein the at least one biasing element is a torsion spring that is adapted to rotate the at least one protuberance into the slot when material does not displace the thickness gauge.

9. The shredder head of claim 1, wherein when the thickness gauge indicates that the thickness of material inserted into the shredder head exceeds a predetermined amount, the controller deactivates the motor.

10. The shredder head of claim 1, wherein when the thickness gauge is in the first position the motor is not powered.

* * * * *